United States Patent [19]

Rognmo

[11] 4,157,068

[45] Jun. 5, 1979

[54] MISSILE FOR DISCHARGE TOWARDS A TARGET

[75] Inventor: Tore Rognmo, Kongsberg, Norway

[73] Assignee: A/S Kongsberg Våpenfabrikk, Norway

[21] Appl. No.: 845,445

[22] Filed: Oct. 25, 1977

[30] Foreign Application Priority Data

Oct. 26, 1976 [NO] Norway ..... 763653

[51] Int. Cl.[2] ..... F42C 11/04

[52] U.S. Cl. ..... 102/69; 102/208

[58] Field of Search ..... 102/7.2, 69, 208, 211; 244/3.16

[56] References Cited

U.S. PATENT DOCUMENTS

| | | | |
|---|---|---|---|
| 3,295,444 | 1/1967 | Cushing et al. | 102/7.2 |
| 3,826,193 | 7/1974 | Rognmo et al. | 102/208 |
| 3,908,551 | 9/1975 | Dahl | 102/208 |
| 4,112,848 | 9/1978 | Lallinger | 102/69 |

*Primary Examiner*—Verlin R. Pendegrass

*Attorney, Agent, or Firm*—Holman & Stern

[57] ABSTRACT

A missile for discharge towards a target, comprises a power source, an explosive charge, a release unit, and a sensor means adapted to influence the release unit in response to certain conditions appearing during the flight of the missile towards the target. The missile further comprises a plurality of explosive elements which have their own power source, explosive charge, detonator unit and sensor means, and which under the influence of the release unit are separated from the missile and independently thereof approach the target for under certain conditions sensed by the sensor means to detonate individually at a desired distance from the target. The power source of each explosive element is a chargeable condensor battery which during the flight of the missile is connected to and charged by the power source of the missile. The power source of the missile comprises a rotating generator mounted in the front part of the missile and driven by ram-air during the flight thereof.

11 Claims, 4 Drawing Figures

MISSILE FOR DISCHARGE TOWARDS A TARGET

BACKGROUND OF THE INVENTION

1. Field of the Invention

The present invention relates to a missile for discharge towards a target, comprising a power source, an explosive charge, a release unit, a sensor means adapted to influence the release unit in response to certain conditions appearing during the flight of the missile towards the target, and a plurality of explosive elements which have their own power source, explosive charge, detonator unit and sensor means, and which under the influence of the release unit are separated from the missile and independently thereof approach the target for under certain conditions senses by the sensor means to detonate individually at a desired distance from the target.

2. Description of the Prior Art

Target-aimed missiles may for example be discharged as a projectile by means of a gun so as to attain such a velocity that they approach the intended targets via desired ballistic paths. The missiles may possibly be fired from a launching pad and they will then comprise a rocket or other suitable propelling means which follows the missile and imposes thereonto the propulsion necessary for achieving a predetermined trajectory.

Such missiles are usually equipped with a device which at a certain point of the trajectory generates a signal which gives rise to detonation of the explosive charge of the missile in proximity of the target. The point of detonation is preferably chosen so as to make the explosion effect of the missile as efficient as possible, and if the parameters of the trajectory are known, this point may for example be determined by means of a timer means which generates a detonation signal at a certain time after launching. Alternatively, the point of detonation may be determined by means of a device which senses how far the missile is from the target, and which generates a signal which gives rise to detonation when the missile is closer to the target than a distance corresponding to a predetermined measurable value. Such a device can for example work according to the Doppler-principle.

Aside from trying to achieve an optimum explosion effect in such missiles by determining the most favourable point of detonation relative to the target, it has also been suggested to use missiles comprising a series of small pieces or fragments which encircle the explosion charge, and which when the missile is detonated, are scattered and thrown against the target with great force.

From U.S. Pat. No. 3,818,833 there is known a missile comprising a fragmentary explosive head which, when fired, propels the fragments in a forward direction towards the target. The missile releases each head either after a predetermined interval from launching or when in range of the target, for tangential separation from each other while retaining their aimed orientation so that the fragments of one head will not interfere with fragments fired from other heads and so that a wide target area will be covered by the fragments of these several heads. In a specific embodiment of plurality of forward firing heads are fired by a proximity fuse after having been released from the missile.

SUMMARY OF THE INVENTION

The present invention relates to a missile for discharge towards a target, housing a series of active detonatable units which at a certain point of the trajectory of the carrying missile are released therefrom and fall towards the target in a more or less scattered formation until at a suitable distance from the target they are detonated independently due to their own proximity fuse systems.

An object of the present invention is to provide a missile of this type having a series of advantages especially as to maintenance and safety.

Another object is to provide a finished assembled missile which can be stored for longer periods of time without the electrical or electronic components being damaged.

Still another object is to provide a missile which during and after the launching has an extra safety against unintentional detonation of the explosive charges caused by the influence of undesired jamming signals.

These and other objects are achieved in a missile of the type stated in the preamble which is characterized in that the power source of each explosive element is a chargeable condensor battery, which during the flight of the missile is connected to and charged by the power source of the missile.

Preferably this power source is a ram-air driven generator which operates only during the flight of the projectile, which involves that the charging of the condensor batteries does not take place till after the missile has left the launching site. Further, each of the explosive elements according to the invention is so adapted that the stored energy in the individual condensor batteries will be effective only when the individual elements are separated from the carrier missile.

Each of the detonatable elements may consist of disc segments which in the missile are assembled to substantially annular discs stacked in the longitudinal direction of the missile. Preferably, the elements are of such a shape that when assembled in the missile, they define a longitudinal central chamber extending in the longitudinal direction of the missile.

In the longitudinal chamber there may be inserted a tube housing firing leads which are connected to an explosive charge, and which transmit firing pulses to the explosives for the detonation thereof upon signal from the release unit of the missile. The explosive charge serves to release the explosive elements from the missile, thus allowing the individual explosive elements to approach the intended target in a more or less gathered group.

Further features and advantages in connection with the present invention will appear from the following description, reference being had to the drawings, which illustrate a preferred embodiment of the invention.

DESCRIPTION OF A PREFERRED EMBODIMENT

Figure 1:
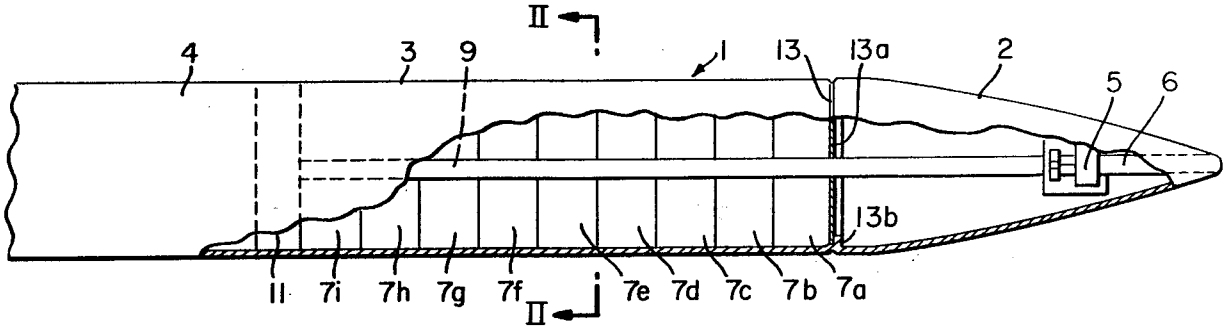
FIG. 1 is a diagrammatic view, partly in section, of a part of a missile according to the invention.

In FIG. 1, 1 is the general designation of a missile consisting of a conical front part 2, a cylindrical intermediate part 3, and a cylindrical rear part 4. In the front part 2 of the missile there is provided a power source 5, which preferably is a ram-air driven generator which is supplied with ram-air through a passage 6 opening into the tip portion of the front part. When the missile moves through the air, ram-air is passed through the passage 6 so as to drive the turbine wheel of the generator for generating electric energy for the electric components following the missile. These components comprise, inter alia, a release unit and a sensor means (not shown), the sensor means being adapted so as to influence the release unit in response to certain conditions prevailing during the flight of the missile towards the target. For reasons of simplicity the release unit and the sensor means are omitted in the drawing, such units being well known for people versed in this field of technics. A further description of a preferred embodiment of a ram-air generator is given in U.S. Pat. No. 3,826,193.

Figure 2:
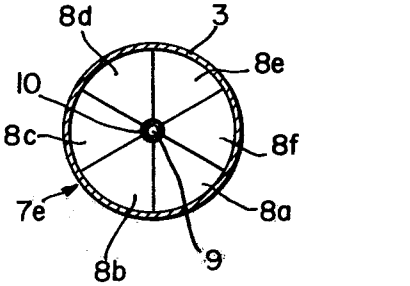
FIG. 2 is a section taken along the line II—II in FIG. 1.

In the cylindrical intermediate part 3 of the missile 1 there are provided a series of adjacent groups of explosive elements *7a–7i*. Each group consists of disc sectors which in the missile are assembled into annular discs stacked in the longitudinal direction thereof. In FIG. 1 there are illustrated nine such disc-shaped groups of explosive elements and as depicted in FIG. 2, each of the disc-shaped groups may consist of six sector shaped elements *8a–8f*. The explosive elements *8a–8f* have such a shape that when put together in the missile 1 they confine an elongated central chamber 9 extending in the longitudinal direction of the missile in the cylindrical part 3 thereof. In the elongated chamber 9 there is inserted a tube 10 extending from the conical front part 2 through the cylindrical intermediate part 3 and opening into a chamber 11 between the cylindrical intermediate part 3 and the cylindical rear part 4. The chamber 11 houses a suitable amount of explosives with firing means (not shown) which via firing leads 12 (FIG. 3) extending through the tube 11 receive signals from the release unit in the front part 2 of the missile, said signals effecting detonation of the explosives in the chamber 11 for releasing the explosive elements in the cylindrical part 3. Upon detonation of the explosives in the chamber 11 a reduced portion 13 between the front part 2 of the missile and the cylindrical part 3 housing the explosive elements *7a–7i* will be torn apart to pieces and the explosive elements *7a–7i* pushed out of the part 3. In the area of the reduced portion 13 there is provided a partition wall *13a* which aside from serving as an end wall of the cylindrical part 3, also serves to transfer the explosion effect of the explosives in the chamber 11 to the front part 2 of the missile, the edge portion of the partition wall bearing against a bead 13 extending around the inner surface of the front part 2.

When the explosive elements are separated from the missile, they will independently thereof approach the target and detonate at a desired distance therefrom by their own explosives which are detonated by the respective sensor means. Preferably the sensor means comprise components which are so connected as to give the elements a function of a proximity fuse. The swarm of explosive elements approaching the target may then independently of the missile and independently of each other, be detonated at a suitable distance from the target. To ensure detonation of the explosive elements even upon failure of the proximity function, each explosive element may be equipped with a percussion switch, which comes into effect when the element hits the ground, and then actuates the detonator unit for detonating the explosive charge.

Figure 3:
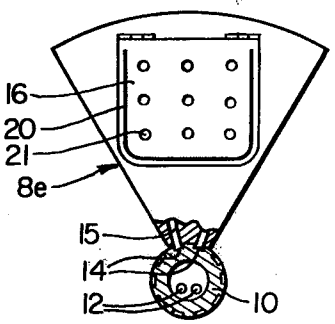
FIG. 3 is on a larger scale a side view of an explosive element with lowered wings and mounted on a central tube extending in the longitudinal direction of the missile.

A condensor battery is used as an energy source for the electronic functions of each of the explosive elements. The condensor battery is charged during the flight of the missile towards the target, the charging being effected by current generated by the ram-air generator 5 in the front part 2 of the missile. On the outside of the tube 10 extending in the longitudinal direction of the missile, there are provided bus bars 14 to which the explosive elements, i.e. the explosive element *8e* in FIG. 3, are connected through spring-loaded contact pieces 15. The spring-loaded contact pieces 15 can upon release of the explosive elements from the missile establish a connection which arms the explosive element.

The arrangement comprising the chargeable condensor battery is of great advantage, especially with respect to maintenance and safety. By connecting the cargeable condensor battery to an air driven generator which is effective only during the flight of the projectile, i.e. subsequent to the launching of the missile, the charging of the condensor battery to a value sufficient for reliable operation of the individual explosive elements, will not take place until a certain time after the missile has left the launching pad. A further safety is built into the system in that the charged energy of the condensor batteries only will be effective after the individual elements have been separated from the carrying missile.

The use of chargeable condensor batteries involves that the finished assembled missiles can be stored for a longer period of time without any of the electrical or electronic components being damaged. This would not be the case if pre-charged dry batteries were to be used instead of the chargeable condensor batteries, dry batteries being prone to leakage and other failures which render the explosive elements inoperative.

The charging of the condensor battery subsequent to the launching of the missile, also provides an extra safety against unintentional detonation of the missile due to undesired jamming signals.

It should be noted that the design of the proximity circuitry may be of a type as described in U.S. Pat. Nos. 3,802,343 or 3,934,510, both of which have been assigned to the assignee of the present invention. Further it is to be noted that the connection to the individual chargeable condensor batteries of each explosive element may easily be adapted to the circuits disclosed in the said patent specification.

Figure 4:
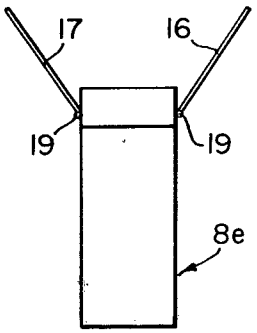
FIG. 4 is a front view of an explosive element released from the missile and with the wings in raised position.

As best illustrated in FIGS. 3 and 4, each explosive element is equipped with a pair of wings 16 and 17 which are mounted on spring-loaded hinges 19, and which in mounted position of the elements in the missile are urged against the outer surface of the elements and the wings of the adjacent elements and in released position under the influence of the spring force of the hinges are forced to pivot about the hinges 19 to a position which for example is illustrated in FIG. 4. In the position of the wings 16, 17 illustrated in FIG. 4, i.e. when the element *8e* is released from the missile, the wings will guide the falling element so that the narrowest portion thereof will always point downwards.

As illustrated at 20 in FIG. 3, the wings 16 and 17 are equipped with antennas, preferably loop antennas, which extend along the circumference of the wings and to the lateral surface of the element in order close to the narrower portion of the element to merge with the electronic components accommodated therein. It is to be understood that when the wings are in raised position, as illustrated in FIG. 4, the loop antennas will transmit an antenna diagram having lobes which substantially point downwards. This is especially favourable when the missile is to be used against a ground target. However, it is to be understood that if the missile is to be used in connection with other targets than ground targets, it is possible to give the antenna diagrams a different configuration. In the wings 16 and 17 there are provided holes 21 for stable guiding of the elements when these are falling freely. Of course, the wings may be designed in various ways, i.e. with guiding fins or the like in order to achieve a most possible uniform falling position of the explosive elements. Possible the holes may be scoop-shaped at their upper edges.

In addition to the explosives housed in the chamber 11 between the cylindrical intermediate part 3 and the cylindrical rear part 4, there is also provided an explosive (not shown) in the front part 2 of the projectile. The release unit housed in the front part 2 of the projectile is therefore adapted so as to primarily influence a release mechanism which releases the individual explosive elements from the missile, i.e. the explosive which is in the chamber 11, and secondarily influences the explosive which is in the front part 2. If the primary released mechanism should fail, i.e. the release of the individual explosive elements should be prevented, the secondary release mechanism which gives rise to detonation of the explosive of the front part 2 of the missile will give rise to the detonation not only of the explosive in the front part 2 of the missile, bur also of all of the explosive elements in the intermediate part 3 of the missile and the explosive in the chamber 11. This can be achieved by giving the partition wall 13*a* between the front part 2 and the cylindrical intermediate part 3 such properties that it will afford a large resistance against collapse when influenced by pressure in the direction from the chamber 11 towards the front part 2, whereas it may easily collapse under the influence of pressure forces directed from the front part 2 towards the cylindrical part 3.

What I claim is:

1. An missile for discharge towards a target, comprising a power source, an explosive charge, a release unit, a sensor means adapted to influence the release unit in response to certain conditions appearing during the flight of the missile towards the target, and a plurality of explosive elements which have their own power source, explosive charge, detonator unit, and sensor means, and which under the influence of the release unit are separated from the missile and independently thereof approach the target for under certain conditions sensed by the sensor means to detonate individually at a desired distance from the target, characterized in that the power source of each explosive element (7*a*–7*i*, 8*a*–8*f*) is a chargeable condensor battery which during the flight of the missile (1) is connected to and charged by the power source of the missile.

2. A missile as specified in claim 1, characterized in that the power source of the missile comprises a rotating generator.

3. A missile as specified in claim 2, characterized in that the generator (5) is mounted in the front part (2) of the missile and is driven by ram-air.

4. A missile as specified in claim 1, characterized in that the explosive elements (7*a*–7*i*) consist of disc sectors (8*a*–8*f*) which in the missile are assembled into substantially annular discs stacked in the longitudinal direction of the missile.

5. A missile as specified in claim 4, characterized in that the explosive elements (8*a*–8*f*) are so formed that in assembled position in the missile they define an elongated central chamber (9) extending in the longitudinal direction of the missile.

6. A missile as specified in claim 5, characterized in that the elongated chamber (9) there is inserted a tube (10) housing firing leads (12) extending between the chamber (11) and the release unit in the front part (2) and transmitting fire pulses to the explosives.

7. A missile as specified in claim 6, characterized by leads extending on the outside of the tube (10), said leads being connected on one side to the power source of the missile and on the other side to the respective explosive elements (7*a*–7*i*, 8*a*–8*f*).

8. A missile as specified in claim 7, characterized in that the leads take the form of bus bars (14) and that the explosive elements (8*e*) are connected to the bus bars (14) through spring-loaded contact pieces (15).

9. A missile as specified in claim 8, characterized in that the spring-loaded contact pieces (15) upon release of the explosive elements (8*a*) from the missile make a contact which arms the explosive element (8*e*).

10. A missile as specified in claim 1, characterized in that the release unit of the missile is adapted so as to influence release mechanisms (11) which release each of the explosive element (7*a*–7*i*) from the missile.

11. A missile as specified in claim 10, characterized in that the explosive elements (7*a*–7*i*) are monted in a cylindrical portion (3) of the missile (1), which at its one end merges with a conical front part (2) housing control means, and which at its other end merges with a cylindrical rear part (4), that a reduced portion (13) is mounted between the front part (2) and the cylindrical part (3) housing the explosive elements (7*a*–7*i*), and that between the cylindrical part (3) and the rear part (4) there is formed a chamber (11) which houses suitable amounts of explosives, and which is connected to firing means responding to signal from the release unit of the missile to effect detonation of the explosives for tearing the reduced portion (13) apart and releasing the explosive elements.

* * * * *